US008205975B2

(12) United States Patent
Iketani et al.

(10) Patent No.: US 8,205,975 B2
(45) Date of Patent: Jun. 26, 2012

(54) RECORDING APPARATUS

(75) Inventors: Masaru Iketani, Atsugi (JP); Yukuo Yamaguchi, Tokyo (JP); Kiyomitsu Kudo, Machida (JP); Yasushi Iijima, Tokyo (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 382 days.

(21) Appl. No.: 12/546,420

(22) Filed: Aug. 24, 2009

(65) Prior Publication Data

US 2010/0045744 A1 Feb. 25, 2010

(30) Foreign Application Priority Data

Aug. 25, 2008 (JP) ..... 2008-215697

(51) Int. Cl.
*B41J 2/175* (2006.01)

(52) U.S. Cl. ..... 347/87; 347/86; 347/50; 347/85

(58) Field of Classification Search ..... 347/87, 347/86, 50, 85
See application file for complete search history.

(56) References Cited

U.S. PATENT DOCUMENTS 6,053,598 A * 4/2000 Inpyn ..... 347/49
6,910,759 B2 6/2005 Kawamura
2002/0071002 A1* 6/2002 Kawamura et al. ..... 347/50
* cited by examiner

*Primary Examiner* — Matthew Luu
*Assistant Examiner* — Henok Legesse
(74) *Attorney, Agent, or Firm* — Canon USA Inc IP Division

(57) ABSTRACT

A recording apparatus for performing recording by reciprocally moving a liquid discharge head includes the liquid discharge head, which includes a case, a connection terminal group including a plurality of connection terminals capable of electrically connecting to the recording apparatus and which is provided on one face of the case, a liquid discharge substrate for discharging a liquid from a discharge port according to a signal transmitted from the recording apparatus via the connection terminals, and a supporting substrate supporting the liquid discharge substrate, which is provided on another one face of the case. The recording apparatus includes a standby area provided on the one end of the recording apparatus where the liquid discharge head is on stand-by when recording is not performed, and a carriage including a connection terminal which can electrically connect to the liquid discharge head, is mounted with the liquid discharge head, and reciprocally moves between the standby area and another end of the recording apparatus.

10 Claims, 12 Drawing Sheets

FIG. 10 (PRIOR ART)
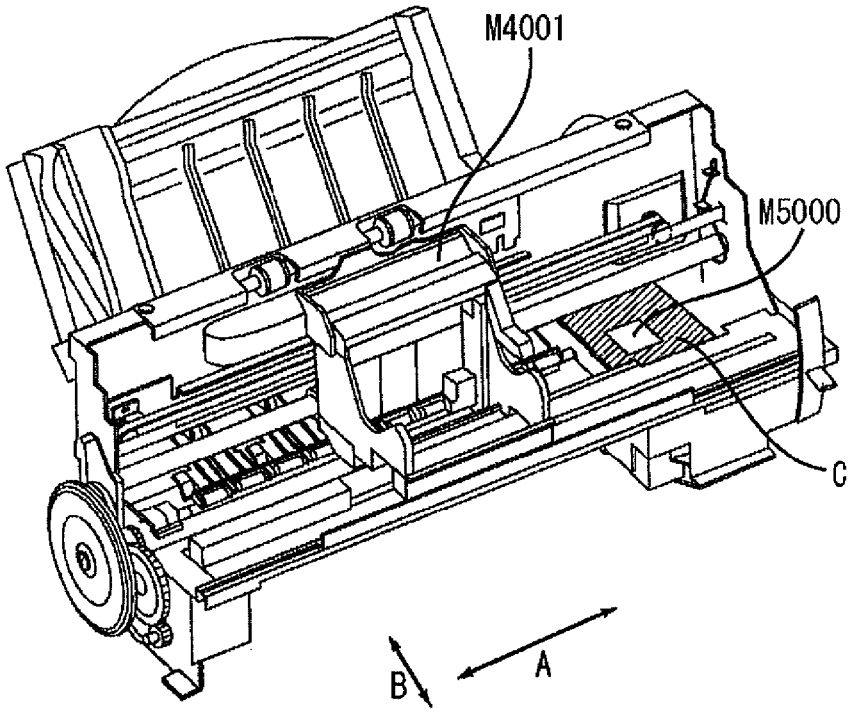

RECORDING APPARATUS

BACKGROUND OF THE INVENTION

1. Field of the Invention

The present invention relates to a recording apparatus using a liquid discharge head for discharging a liquid such as ink and performing recording on a recording medium.

2. Description of the Related Art

As for a recording apparatus using a liquid discharge head such as an inkjet recording head, for example, a serial scan-typed inkjet recording apparatus (it will be called as a recording apparatus below) is known. This recording apparatus performs recording by reciprocally moving a liquid discharge head (hereinafter referred to as a recording head) on a recording medium.

A general configuration of the serial scan-type recording apparatus will be described as an example with reference to FIG. 10.

The serial scan-type recording apparatus performs recording by repeating an operation for discharging ink toward a recording medium from a discharge port of a recording head, and an operation for conveying the recording medium in a sub scanning direction intersecting with the main scanning direction in which the recording head is reciprocally moved. In FIG. 10, the main scanning direction is illustrated with an arrow A, and the subs-canning direction is illustrated with an arrow B.

The recording apparatus mounts the recording head on a carriage 4001 and performs recording by reciprocally moving the carriage 4001 in the main scanning direction A. In a standby area C which is a home position, a cap member 5000 is provided. The cap member 5000 seals the discharge port of the recording head to prevent ink within the discharge port from drying when recording is not performed. A recovery mechanism for maintaining reliability of ink discharge is also provided, and an installation area for the mechanism is secured in the recording apparatus.

A particular configuration of the recording head will be described with reference to FIG. 11, using an example of a recording head discussed in U.S. Pat. No. 6,910,759.

The recording head illustrated in FIG. 11 is a so-called cartridge-type recording head detachably mounted on a carriage of a recording apparatus main body.

The recording head has a recording element unit 41 including a recording element substrate 48, a supporting substrate 47 provided with a recording element substrate, a wiring tape 43 for transmitting an electric signal to the recording element substrate, and a wiring substrate 42 provided with a contact pad 42 for electrically connecting to a main body.

The recording head includes independent ink tanks (not illustrated) of, for example, four colors such as black, cyan, magenta, and yellow. These ink tanks are independently and detachably attached to an ink supply unit 40 respectively.

When the recording head is attached to the recording apparatus, the contact pad 42*a* arranged on the wiring substrate 42 contacts a contact pin attached in a main body carriage so as to electrically connect the recording apparatus to the recording head. At this time, the wiring substrate 42 receives repulsion from the contact pin attached to the carriage. Therefore, in order to suppress deformation of the ink supply unit 40 or prevent decrease of accuracy with respect to each contact reference when the contact pad 42*a* contacts the contact pin at a time of attaching the recording head to the carriage, the contact pad arranged on the wiring substrate is disposed at a center part of the ink supply unit in a moving direction of the carriage.

A center of the recording element unit 41 in the moving direction of the carriage (a center of the supporting substrate 47) is provided at a position deviating from the center of the ink supply unit 40. In addition, the recording element unit 41 is provided at a position corresponding to the cap member 5000. The cap member 5000 contacts the recording element unit 41 so as to seal the discharge port.

Therefore, an electric connection portion of the wiring tape 43 and the wiring substrate 42 is attached to a position deviating from the center of the wiring substrate 42, which is also a center of the ink supply unit 40. Thus, the wiring tape 43 has a rectangular shape to connect the wiring substrate 42 to the recording element substrate 48 at a shortest distance so that wiring resistance of the wiring tape 43 does not become too large and a number of produced pieces does not decrease.

In recent years, in order to increase a number of ink tanks for multi-color inks for the purpose of acquiring a high quality image and decrease exchange frequency of ink tanks, the capacity of one ink tank has been increasing. Further, even the capacity of the ink tank is same, an attempt is made to decrease a height of the ink tank and enlarge its width so as to miniaturize the recording apparatus in the height direction.

Therefore, the size of the ink supply unit including the ink tanks tends to enlarge in the main scanning direction (an A direction in FIGS. 10 and 12A) as illustrated in FIG. 12B compared with a conventional configuration illustrated in FIGS. 11 and 12A.

When the ink supply unit enlarges, that is, when the recording head enlarges, an area of the recording apparatus body in the side where the standby area C is not provided must be enlarged as illustrated in FIG. 12B, which causes an enlargement of the recording apparatus.

In order to prevent the enlargement of the recording apparatus, as illustrated in FIG. 12C, the center of the supporting substrate 47 can be displaced from the center of the ink supply unit 40, which corresponds to the cap member 5000, without changing the position of the cap member 5000 in the standby area C of the recording apparatus.

As described in FIG. 11, by arranging the center of the electric connection portion of the wiring tape 43 and the wiring substrate 42 at a position displaced from the center of the wiring substrate 42, the center of the supporting substrate 47 is located at a position displaced from the center of the ink supply unit 40 in the conventional apparatus.

However, in the configuration illustrated in FIG. 11, an amount of displacement between the center of the ink supply unit 40 and the center of the supporting substrate 47 depends on a displacement amount between the center of the ink supply unit 40 and the center of the electric connection portion of the wiring tape 43 and the wiring substrate 42. Therefore, as illustrated in FIG. 12C, the amount of displacement between the center of the ink supply unit 40 and the center of the supporting substrate 47 cannot be larger than a certain amount, which causes an enlargement of the recording apparatus.

SUMMARY OF THE INVENTION

The present invention is directed to a recording head capable of increasing an amount of displacement between a center of an ink supply unit and a center of a supporting substrate even when the recording head enlarges in a moving direction of a carriage. The present invention is further directed to a recording head capable of reducing an enlargement of the recording apparatus when a recording head enlarges in a moving direction of a carriage.

According to an aspect of the present invention, a recording apparatus for recording by reciprocally moving a liquid discharge head includes a liquid discharge head, which includes a case, a connection terminals group including a plurality of connection terminals capable of electrically connecting to the recording apparatus, which is provided on one face of the case, a liquid discharge substrate for discharging a liquid from a discharge port according to a signal transmitted from the recording apparatus via the connection terminals, and a supporting substrate for supporting the liquid discharge substrate, which is provided on another one face of the case.

The recording apparatus further includes, a standby area provided on the one end side of the recording apparatus where the liquid discharge head is on stand-by when recording is performed, and a carriage including a connection terminal which can electrically connect to the liquid discharge head, is mounted with the liquid discharge head, and reciprocally moves between the standby area and another end of the recording apparatus.

In a moving direction of the liquid discharge head from the standby area to the another end of the recording apparatus, a center of the connection terminals group is located at a position displaced from a center of the case, and a center of the supporting substrate is located at a position further displaced.

A cap member for covering the discharge port is provided at a position displaced in the moving direction from the center of the standby area.

According to the aforementioned configuration, the a liquid discharge head can be realized which has a larger amount of displacement in a moving direction of the liquid discharge head between a center of a liquid supply member and a center of a supporting substrate than displacement in the conventional liquid discharge head. A standby area of the liquid discharge head can be utilized effectively and the enlargement of the recording apparatus can be suppressed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 10 is a view illustrating a conventional recording apparatus.

DETAILED DESCRIPTION OF THE EMBODIMENTS

Various exemplary embodiments, features, and aspects of the invention will be described in detail below with reference to the drawings.

In this specification, "recording" is not only used when significant information such as a character and a figure is formed, but also used regardless of whether the information is significant or insignificant and regardless of whether the information becomes apparent to the eyes so that humans can visually perceive the information. The "recording" also includes a case where an image, a figure, or a pattern is formed in a broad sense on a recording medium, or when the medium is subjected to processing.

The "recording medium" includes not only a paper used in a general recording apparatus but also a product capable of receiving ink, such as cloth, a plastic film, a metal plate, glass, ceramics, a wood, and a leather.

The "ink" should be interpreted widely like the definition of the "recording" and includes a liquid capable of forming an image, a character, and a pattern, or usable in processing the recording medium or ink. Therefore, the "ink" includes any liquid which can be used for recording.

As one example of a liquid discharge head applicable to a recording apparatus according to the exemplary embodiment of the present invention, an inkjet recording head will be described below with reference to FIG. 1.

Figure 1:
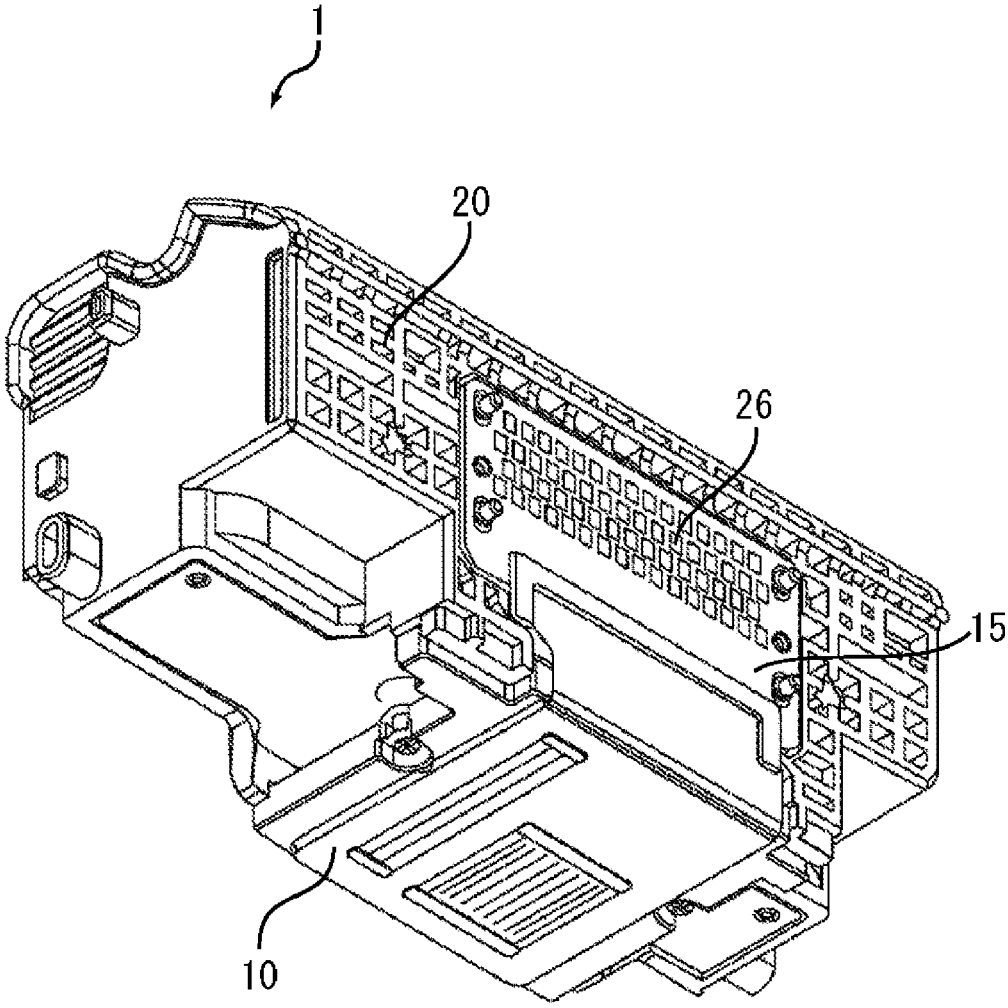
FIG. 1 is a description view illustrating an inkjet recording head as one exemplary embodiment of the present invention.

FIG. 1 is a view illustrating an inkjet recording head (hereinafter referred to as a recording head) according to the exemplary embodiment of the present invention.

Figure 2:
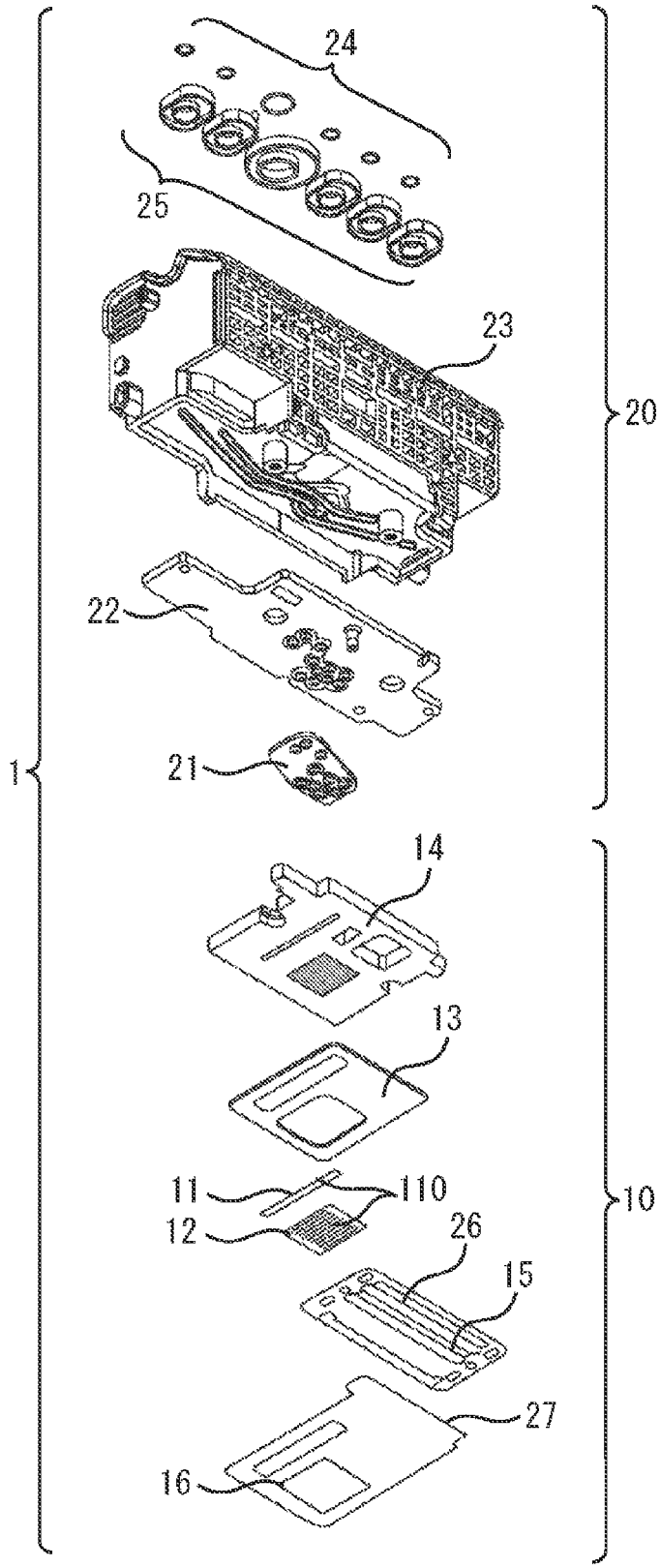
FIG. 2 is an exploded perspective view of an inkjet recording head in FIG. 1.

A recording head 1 includes a recording element unit 10, and an ink supply unit 20 having a flow path for supplying ink supplied from an ink tank (not illustrated) to recording element substrates 11 and 12 of the recording element unit 10 (refer to FIG. 2).

To the recording head 1, six ink tanks of pigment black, dye black, cyan, magenta, yellow and gray can be independently and detachably attached, and can be exchanged separately. According to such a configuration, since ink can be used without uselessly wasting by properly exchanging the ink tanks, a running cost of printing in an inkjet recording apparatus can be suppressed to be low.

Then, each element configuring the recording head 1 will be described in detail below with reference to FIG. 2.

The recording head 1 discharges ink through a discharge port provided at the recording element substrate by driving a recording element according to an electric signal transmitted from the recording apparatus. The ink is supplied from ink tank (not illustrated) storing the ink. As for the recording element, for example, an electrothermal transducer and a piezoelectric element can be used. In this exemplary embodiment, the recording element using the electrothermal transducer is described.

The recording element unit 10 includes a first recording substrate 11 for a black ink and a second recording element substrate 12 for a color ink as liquid discharge substrates, and a first plate 14 and a second plate 13 as supporting substrates of the first and second recording element substrates. The recording element unit 10 further includes a wiring substrate 15 having a plurality of contact pads 26 as connection terminals for electrically connecting a recording apparatus to a recording head, and a wiring tape 16 for electrically connecting the wiring substrate 15 to the first recording element substrate 11 and the second recording element substrate 12.

The recording element substrates 11 and 12 include an electrothermal transducer for generating thermal energy for generating film boiling with respect to ink, and an ink discharge port 110 arranged facing the electrothermal transducer. In the recording element substrates 11 and 12, the electrothermal transducer is driven according to an electric signal transmitted from a recording apparatus via the contact pads 26 and ink is discharged from the ink discharge port 110.

The first plate 14 is, for example, made of an alumina material having a thickness from 0.5 to 10 mm. The material of the first plate 14 is not limited to alumina. The material of the first plate 14 can be made of other materials having a linear expansion coefficient similar to that of the materials of the recording element substrates 11 and 12, or a material having thermal conductivity equal to or more than that of the materials of the recording element substrates 11 and 12. For example, any one of silicon, aluminum nitride, zirconia, silicon nitride, silicon carbide, molybdenum, and tungsten can be used. In the first plate 14, a slit for supplying ink to the first recording element substrate 11 and the second recording element substrate 12 serving as an ink supply port is formed. Further, screwing portions for connecting the first plate 14 and the ink supply unit 20 are formed on the both sides of the first plate 14.

The second plate 13 is, for example, one plate-shaped member having a thickness from 0.5 to 1 mm and made of an alumina material. The second plate 13 has a form having two openings larger than external forms of the first recording element substrate 11 and the second recording element substrate 12, which are bonded and fixed at the first plate 14. The second plate 13 is bonded to the first plate 14 with an adhesive. Therefore, when the wiring tape 16 is bonded, the wiring tape 16 can electrically connect to the first recording element substrate 11 and the second recording element substrate 12 by making contact on a bonding flat surface.

The wiring tape 16 is a signal path for transmitting an electric signal for discharging ink, to the first recording element substrate 11 and the second recording element substrate 12. In the wiring tape 16, two openings corresponding to each recording element substrate 11 and 12 are formed. Electrode terminals connected with an electrode portion of the recording element substitutes 11 and 12 are formed around edges of the openings. An electric connection portion 27 for electrically connecting the wiring tape 16 and the wiring substrate 15 having a plurality of the contact pads 26 is formed at an edge of the wiring tape 16, and the electrode terminals and the electric terminal connection portion are connected with a wiring pattern of a continuous copper foil.

A rear face of the wiring tape 16 is bonded and fixed to a lower face of the second plate 13 by an adhesive and bent to the one side of the first plate 14. As for the adhesive, a thermosetting adhesive including an epoxy resin as its main ingredient and having a thickness from 10 to 100 μm can be used.

A electric connection of the wiring tape 16 to the first recording element substrate 11 and the second recording element substrate 12 is, for example, carried out by electrically bonding the electrode portions of the recording element substrates 11 and 12 and the electrode end of the wiring tape 16 using a thermo ultrasonic compression bonding method. The electric connection portion 27 between the wiring tape 16 and the first and the second recording element substrates 11 and 12 is sealed with a first sealing agent and a second sealing agent, and thus the electric connection portion 27 is protected from corrosion by ink or external impact. The first sealing agent is mainly used for sealing from a rear side of the connection portion 27 of the electrode terminal of the wiring tape 16 and the electrode portions of the recording element substrates 11 and 12, and outer peripheral portions of the recording element substrates 11 and 12. The second sealing agent is used for sealing from a surface side of the connection portion 27.

The electric connection portion 27 of the wiring tape 16 and the wiring substrate 15 are connected by a thermo compression bonding using an anisotropic conductive film and the like. A terminal positioning hole for positioning and a terminal bonding hole for fixing are formed in the wiring substrate 15.

As illustrated in FIG. 2, the ink supply unit 20 as the discharge supply member includes a tank holding member 23 and a flow path forming member 22 attached at a bottom face of the tank holding member 23.

The tank holding member 23 connecting to an ink tank (not illustrated) leads ink from the ink tank to the recording element unit 10 and is, for example, made of a resin. The tank holding member 23 has a connection portion contacting an ink supply port of the ink tank. In the connection portion, a filter 24 for preventing entry of dusts from an external is bonded by welding. Further, a seal rubber 25 is attached to prevent evaporation of ink from the connection portion. Within the tank holding member 23, an ink flow path extending to a lower face from a face of the connection portion which contacts the ink tank is formed.

On the bottom face of the tank holding member 23, a flow path forming member 22, in which an ink introducing port for supplying ink to the recording element unit 10 is opened, is positioned so as to communicate the ink introducing port with the ink flow path of the tank holding member 23, and attached by a ultrasonic welding method.

The recording element unit 10 and the ink supply unit 20 are connected each other sandwiching a joint seal member 21 and press-contacted to be fixed by two screws. The joint seal member 21 has holes formed at positions corresponding to the ink supply port of the first plate 14 and the ink introducing port of the flow path forming member 22. The joint seal member 21 is made of an elastic material showing low permanent distortion in compression, such as a rubber. The joint seal member 21 is sandwiched between the recording element unit 10 and the ink supply unit 20 and press-contacted to communicate the ink supply port with the ink introducing port without generating ink leak.

Figure 3A:
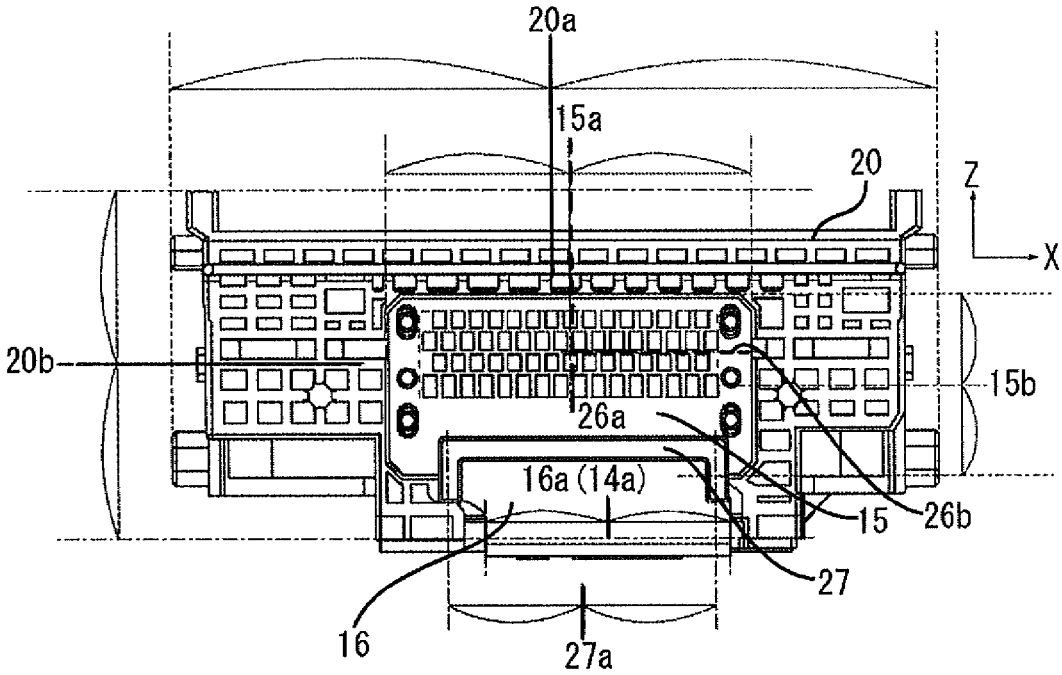
FIGS. 3A and 3B are views illustrating each element of an inkjet recording head in FIG. 1.
Figure 3B:
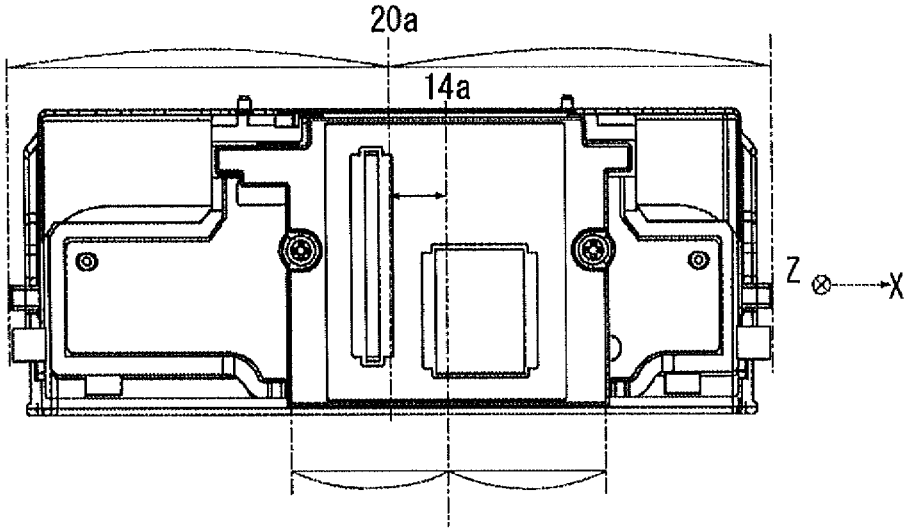

Common words in each exemplary embodiment of the present invention will be defined with reference to FIGS. 3A and 3B.

FIG. 3A is a view illustrating the recording head 1 seen from a side on which the contact pads 26 are formed. FIG. 3B is a view illustrating the recording head 1 seen from the side on which the recording element substrates 11 and 12 are provided.

As illustrated in FIGS. 3A and 3B, in this specification, a center of the liquid supply member (the ink supply unit 20) is 20*a* in the X direction (the first direction) and 20*b* in the Z direction (the second direction). A center of the connection terminal group (the contact pad 26 group) is 26*a* in the X direction and 26*b* in the Z direction. A center of the supporting substrate is 14*a* in the X direction. A center of the wiring substrate 15 is 15*a* in the X direction and 15*b* in the Z direction. A center of the electric connection portion 27 is 27*a* in the x direction. The center of the wiring tape 16 is a center of a width of a portion arranged on the supporting substrate and is 16*a*. The X direction as the first direction is a main scanning direction in which the carriage moves reciprocally when the recording head 1 is mounted on the carriage of the recording apparatus and recording operation is performed. The Z direction as the second direction is vertical to the X direction and runs parallel with a face on which the contact pads 26 are formed.

An aspect ratio of the liquid supply member (the ink supply unit 20) is calculated by a formula of "Width in the X direction/Width in the Z direction" of the liquid supply member (FIG. 3A). The higher the aspect ratio of the liquid supply member, the larger the width of the recording head in the X direction. This value depends on the size of an ink tank mounted on the recording head.

An aspect ratio of the connection terminal group (the contact pad 26 group) is calculated by a formula of "Width in the X direction/Width in the Z direction" of an area in which the contact pads 26 are arranged (FIG. 3A).

A configuration that increases the amount of displacement between the center of the ink supply unit 20 and the center of the supporting substrate will be described below.

The first exemplary embodiment of the present invention will be described with reference to FIG. 4.

Figure 11:
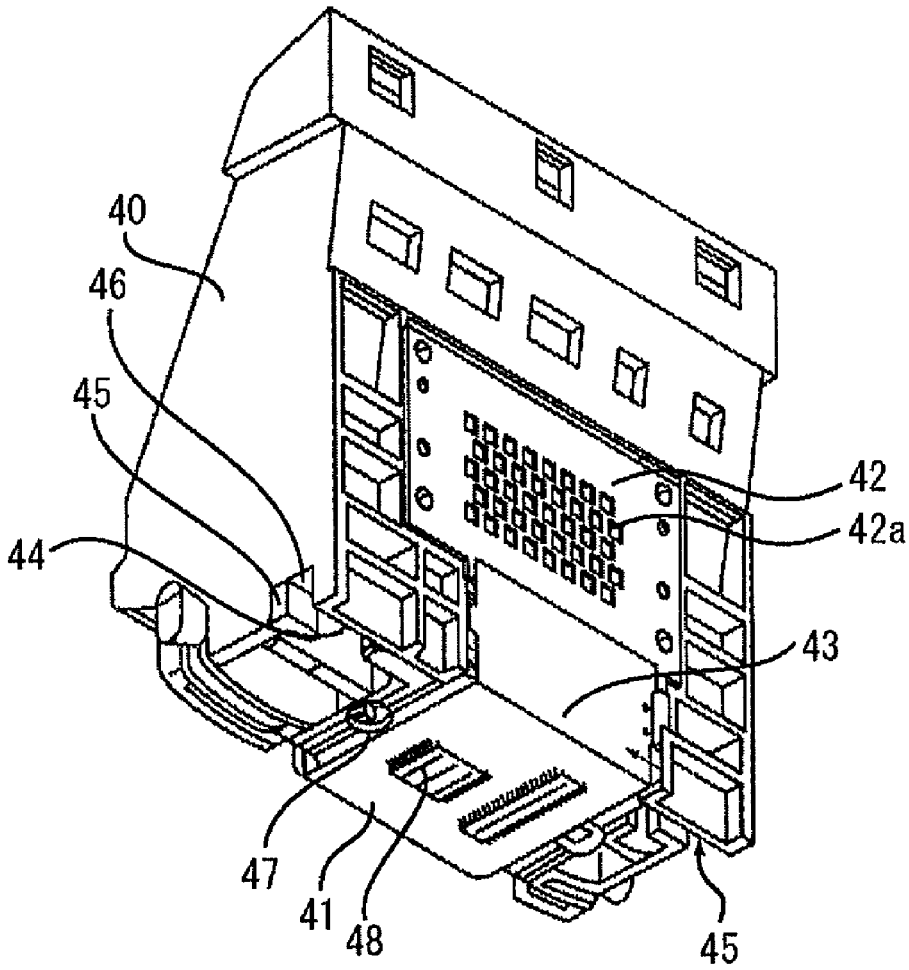
FIG. 11 (PRIOR ART)
FIG. 11 is a perspective outer appearance of a conventional inkjet recording head.

The aspect ratio of the ink supply unit 20 in the recording head of the first exemplary embodiment is about 2.2 (where the width in the X direction is about 97 mm and the width in the Z direction is about 44 mm). This value is larger than the value of an aspect ratio of an ink supply unit in a conventional recording head (e.g., the aspect ratio is about 0.9 in the recording head of FIG. 11) and the recording head of the present invention has a rectangular shape in the X direction.

Figure 4:
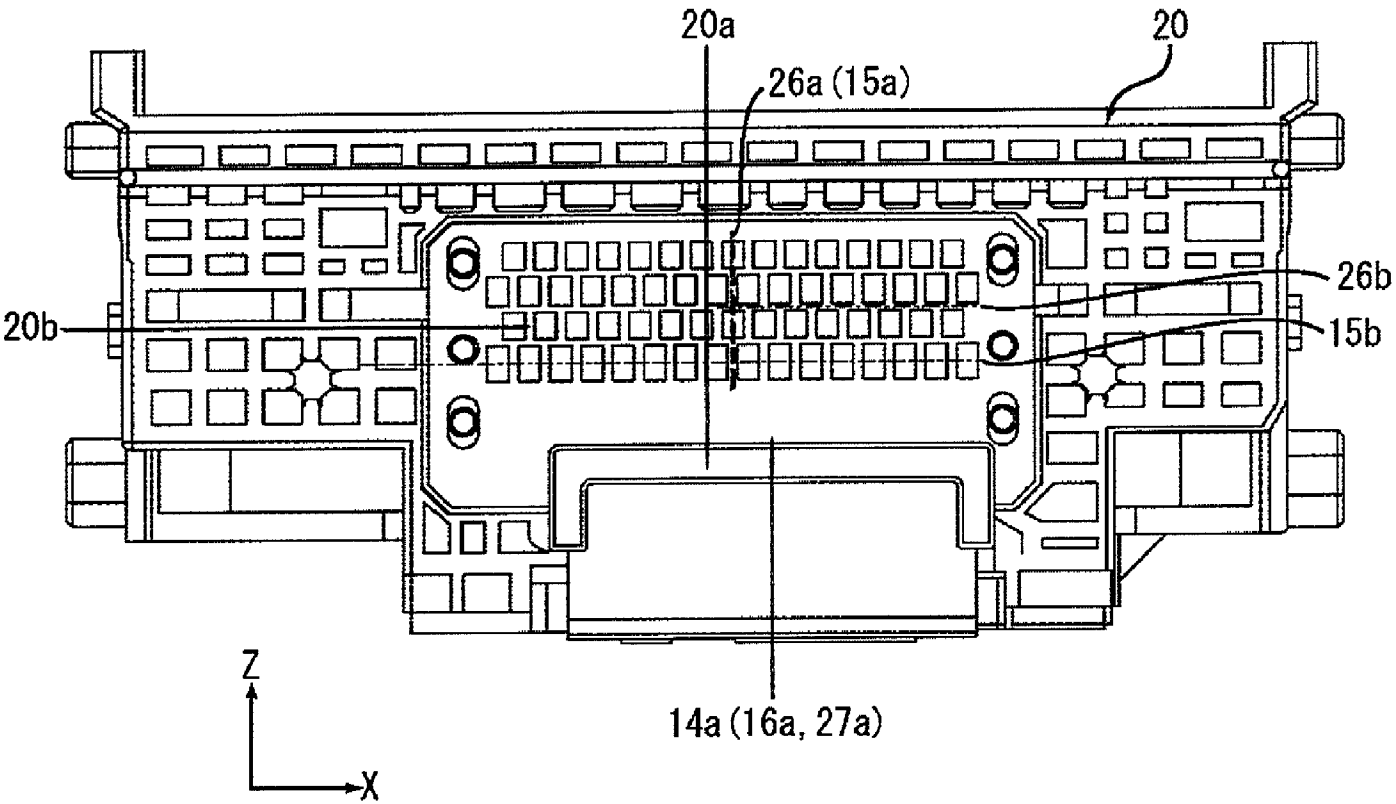
FIG. 4 is a view illustrating the first exemplary embodiment as one example of the present invention.

As illustrated in FIG. 4, in the X direction, the wiring tape 16 is displaced relative to the wiring substrate 15 as much as possible, to a side in which the center 14*a* of the supporting substrate is provided. That is, the center 15*a* of the wiring substrate 15 and the center 27*a* of the electric connection portion 27 are located to be displaced by 2.62 mm. Similar to the conventional example illustrated in FIG. 11A, a certain amount of displacement can be acquired with this configuration.

In the first exemplary embodiment, the center 26*a* of the contact pad 26 group in the X direction is located to be displaced by 2.18 mm from the center of the 20*a* of the ink supply unit 20, so that the amount of displacement in the X direction becomes larger than that in a conventional configuration. With such a configuration, the distance between the center 20*a* of the ink supply unit 20 and the center 14*a* of the supporting substrate can be 4.80 mm.

When the recording head is mounted on the carriage of the recording apparatus, the contact pads 26 receive load from a contact pin of the carriage. Thus, when the center 26*a* of the contact pad 26 group is displaced from the center 20*a* of the ink supply unit 20, a load balance in the X direction can be influenced when the recording head is mounted on the carriage.

However, in the first exemplary embodiment, since the aspect ratio of the ink supply unit 20 is 2 or more, even when the center 26*a* of the contact pad 26 group is displaced from the center 20*a* of the ink supply unit 20, an influence on the load balance in the X direction can be reduced. More particularly, deformation of the ink supply unit 20 can be suppressed and an influence on each contact reference that is contacted when the recording head is mounted on the carriage of the recording apparatus can be reduced.

In the first exemplary embodiment, the aspect ratio of the contact pad 26 group is about 3.5 and larger than the aspect ratio of the ink supply unit 20 which is about 2.2. Thus, the contact pad 26 group is arranged having a wide width in the X direction. The width in the X direction of the contact pad 26 group is about 36.5 mm, and the width in the Z direction is about 10.5 mm. Thus, an influence of the displacement of the center 26*a* of the contact pad 26 group from the center 20*a* of the ink supply unit 20 on the load balance in the X direction can be further reduced, and the load balance in the X direction can be stabilized.

As illustrated in FIG. 4, the center 15*b* of the wiring substrate 15 in the Z direction is more displaced to the side where the supporting substrate is arranged than the center 20*b* of the ink supply unit 20, so that the length of the wiring tape 16 in the Z direction can be shortened. In the first exemplary embodiment, the amount of displacement between the center 15*b* and the center 20*b* is 2.81 mm. By shortening the wiring tape 16, an effect which suppresses an increase of wiring resistance and an increase of cost is achieved. The center 26*b* of the contact pad 26 group in the Z direction is located on a side opposite to the supporting substrate relative to the center 15*b* of the wiring substrate 15, so that the center 26*b* of the contact pad 26 group gets closer to the ink supply unit 20. Thus, the load balance in the Z direction can be stable. In the first exemplary embodiment, the amount of displacement between the center 26*b* and the center 15*b* is 3.87 mm, and the amount of displacement between the center 20*b* and the center 26*b* is 1.06 mm.

According to the aforementioned configuration, a recording head enlarged in the X direction can have a large amount of displacement between the center 20*a* of the ink supply unit 20 and the center 14*a* of the supporting substrate in the X direction while the influence on the load balance is suppressed in the X direction when the recording head is mounted on the carriage.

Further, the recording head shows the stable load balance in the Z direction when the recording head is mounted on the carriage.

Figure 5:
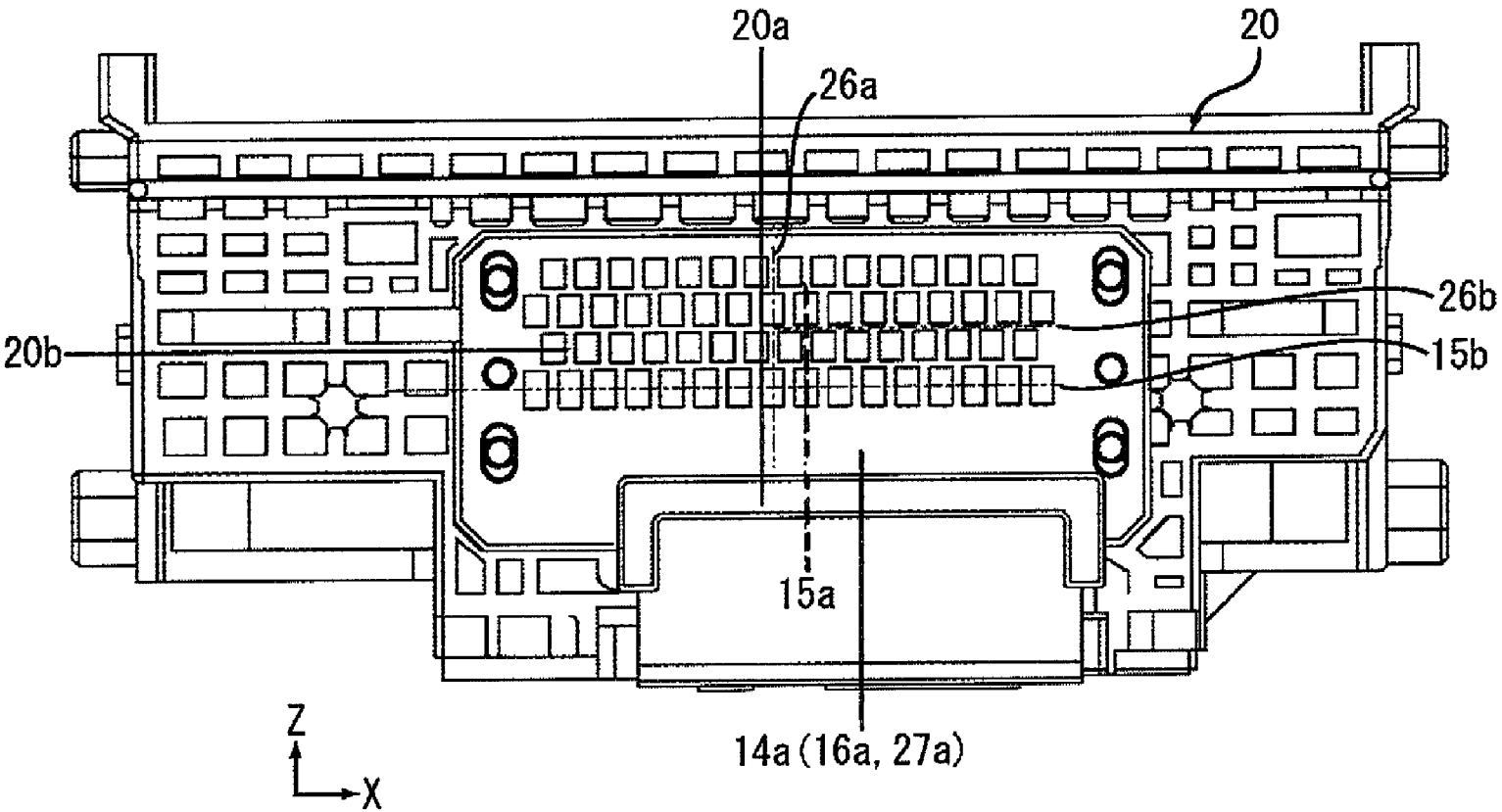
FIG. 5 is a view illustrating the second exemplary embodiment as one example of the present invention.

The second exemplary embodiment of the present invention will be described in detail below with reference to FIG. 5.

In the second exemplary embodiment of the present invention, the center 15*a* of the wiring substrate 15 in the X direction is more displaced than the center 15*a* in the first exemplary embodiment, so that the amount of displacement between the center 20*a* of the ink supply unit 20 and the center 14*a* of the supporting substrate 14 becomes larger. In the second exemplary embodiment, the amount of displacement between the center 20*a* and the center 26*a* is 0.81 mm, the amount of displacement between the centers 26*a* and 15*a* is 2.82 mm, and the amount of displacement between the centers 15*a* and 14*a* (16*a* and 27*a*) is 3.23 mm. According to the configuration of the second exemplary embodiment, the distance between the center 20*a* of the ink supply unit 20 and the center 14*a* of the supporting substrate can be 6.86 mm.

In the second exemplary embodiment, in a portion from the center 26*a* to the center 15*a* and from the center 15*a* to the center 14*a*, the amount of displacement can be increased, so that the amount of displacement between the center 20*a* and the center 26*a* can be decreased more than the amount of displacement in the first exemplary embodiment. Thus, an influence of the amount of displacement between the centers 20*a* and 26*a* on the load balance in the X direction can be reduced.

In addition, the aspect ratio of the ink supply unit 20 in the second exemplary embodiment is about 2.2, in which the ink supply unit 20 is configured similar to the first exemplary embodiment. The aspect ratio of the contact pad 26 group is about 3.2 (where the width in the X direction is about 34.0 mm and the width in the Z direction is about 10.5 mm).

In the second exemplary embodiment, configurations similar to those of the first exemplary embodiment have similar effects to those of the first exemplary embodiment.

The third exemplary embodiment of the present invention will be described in detail below with reference to FIG. 6.

Figure 6:
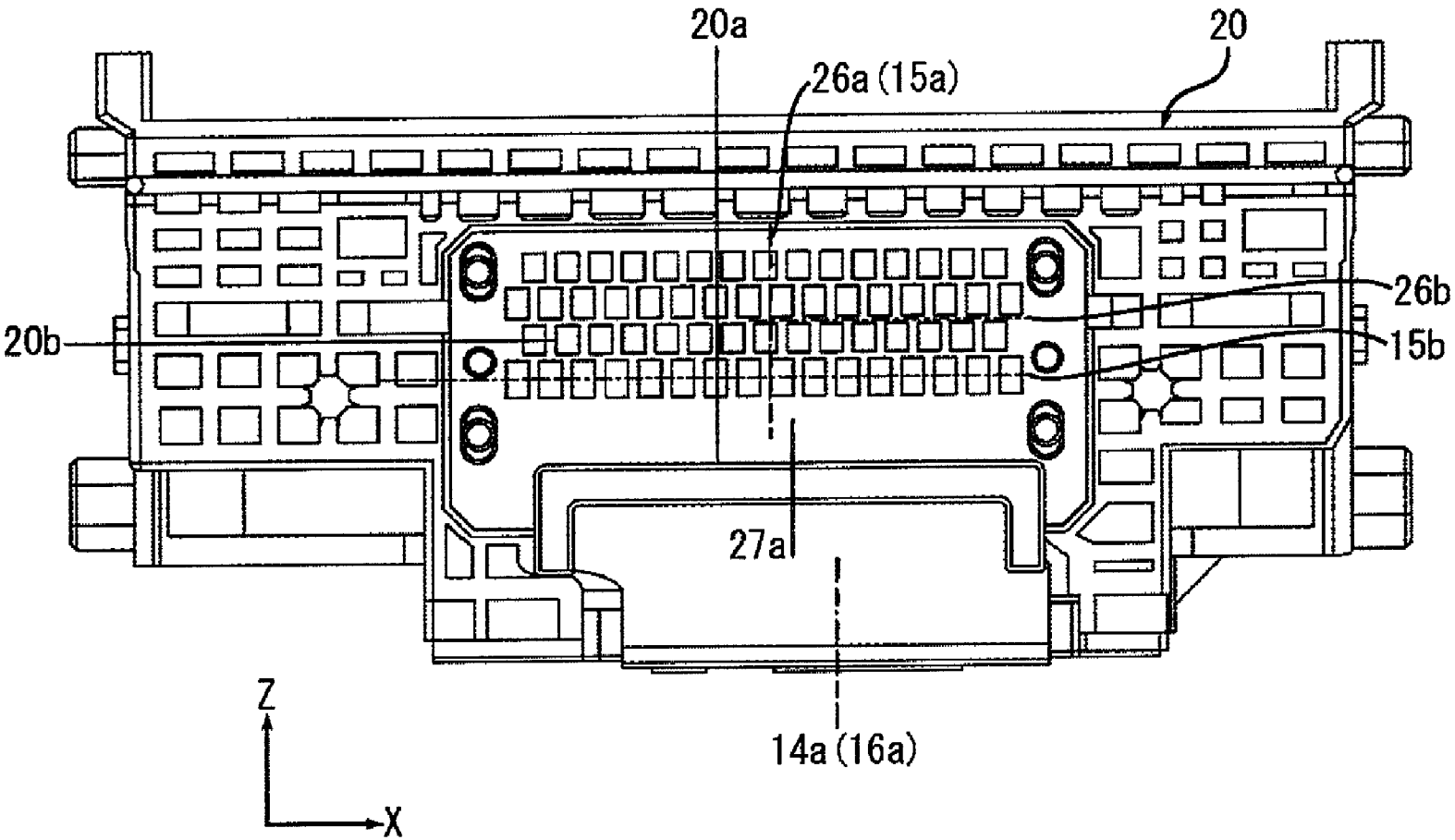
FIG. 6 is a view illustrating the third exemplary embodiment as one example of the present invention.

As illustrated in FIG. 6, a configuration of the third exemplary embodiment is different from the configuration of the first exemplary embodiment in that the center 27*a* of the electric connection portion 27 is located between the center 26*a* of the contact pad 26 group and the center 14*a* of the wiring substrate.

By displacing the center 14*a* of the supporting substrate (the center 16*a* of the wiring tape 16) from the center 27*a* of the electric connection portion 27, the amount of displacement between the center 20*a* of the ink supply unit 20 and the center 14*a* of the supporting substrate can be enlarged. In the third exemplary embodiment, the amount of displacement between the centers 20*a* and 26*a* (15*a*) is 2.00 mm, the amount of displacement between the centers 26*a* (15*a*) and 27*a* is 1.70 mm, the amount of displacement between the centers 27*a* and 14*a* (16*a* and 27*a*) is 2.68 mm, and the amount of displacement between the 27*a* and 14*a* is 3.25 mm. With such a configuration, the distance between the center 20*a* of the ink supply unit 20 and the center 14*a* of the supporting substrate can become 7.05 mm.

In the third exemplary embodiment, the amount of displacement between the centers 27*a* and 14*a* can be enlarged, so that an increase of cost due to an increase of the wiring substrate 15 in the X direction can be suppressed more than the second exemplary embodiment.

Further, in the third exemplary embodiment, the amount of displacement between the centers 20*a* and 14*a* can be enlarged more than the first exemplary embodiment.

Furthermore, in the third exemplary embodiment, when the amount of displacement in the third exemplary embodiment is same as that in the first exemplary embodiment, the distance between the centers 14*a* (16*a*) and 27*a* can be enlarged more than that between the centers 20*a* and 26*a*, so that the amount of displacement between the centers 20*a* and 26*a* can be decreased. Thus, the influence of the amount of displacement between the centers 20*a* and 26*a* on the load balance in the X direction can be more reduced.

In the third exemplary embodiment, a shape of wiring tape 16 is not rectangular because of the displacement between the center 16*a* of the wiring tape 16 and the center 27*a* of the electric connection portion 27. However, cost increase due to reduction of the number of produced pieces can be suppressed by bending the wiring tape 16 as long as the shape of the wiring tape allows.

Further, by making the distance between the center 14*a* of the supporting substrate (the center 16*a* of the wiring tape 16) and the center 27*a* of the electric connection portion 27 to be larger than the distance between the center 20*a* of the ink supply unit 20 and the center 26*a* of the contact pad 26 group, the amount of displacement between the centers 20*a* and 26*a* can be decreased.

The aspect ratio of the ink supply unit 20 in the third exemplary embodiment is about 2.2 in which the configuration similar to the first exemplary embodiment is used. The aspect ratio of the contact pad 26 group is about 3.5 in which the configuration similar to the first exemplary embodiment is used. In the third exemplary embodiments, configurations similar to the first and second exemplary embodiments show effects similar to the first and second exemplary embodiments.

The fourth exemplary embodiment of the present invention will be described in detail below with reference to FIG. 7.

Figure 7:
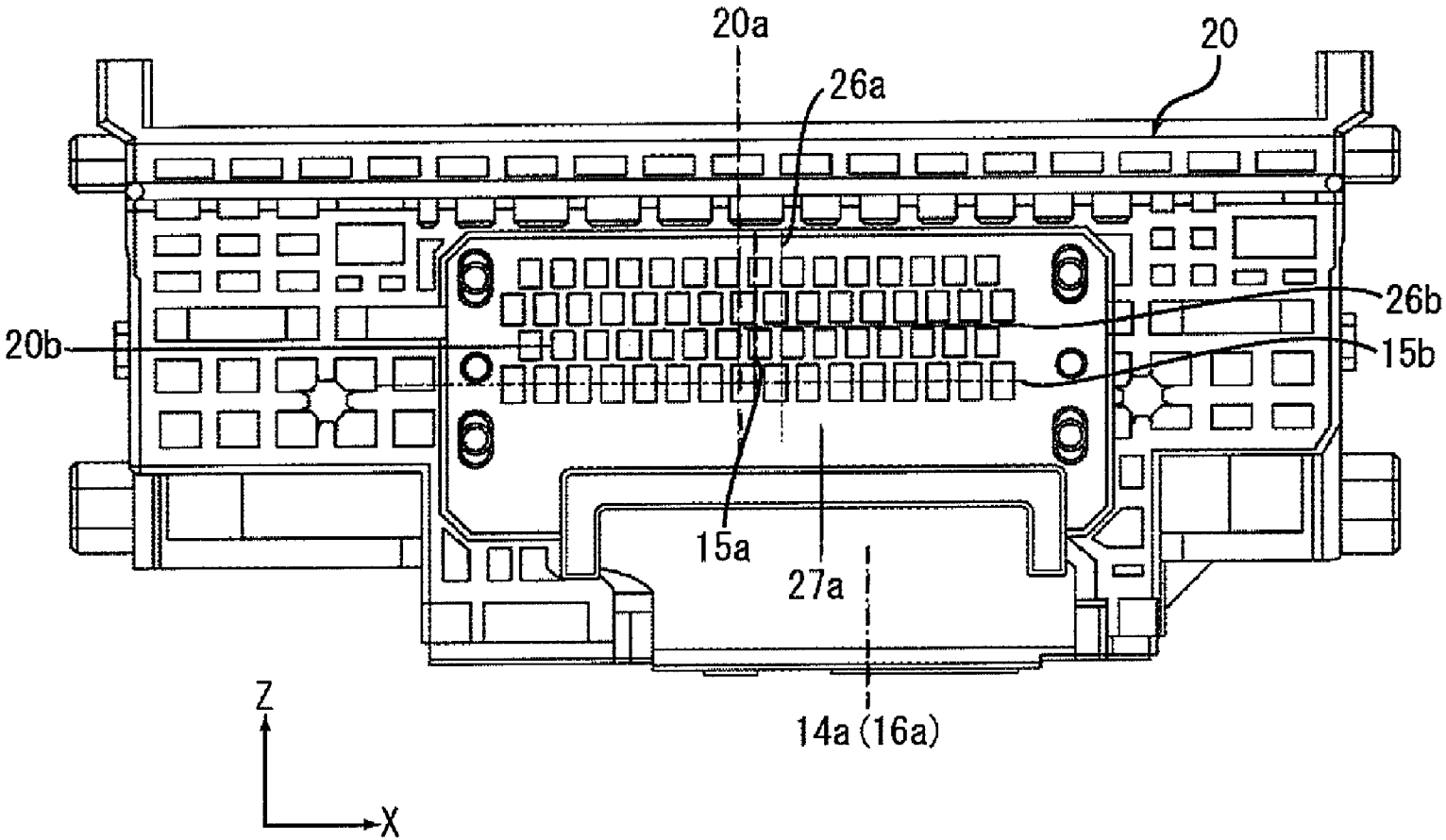
FIG. 7 is a view illustrating the fourth exemplary embodiment as one example of the present invention.

As illustrated in FIG. 7, in the fourth exemplary embodiment, the center 26*a* of the contact pad 26 group and the center 15*a* of the wiring substrate 15 are displaced from the center 20*a* of the ink supply unit 20, and the center 27*a* of the electric connection portion 27 is displaced from the center 14*a* of the supporting substrate. In the fourth exemplary embodiment, the amount of displacement between the centers 20*a* and 26*a* is 1.12 mm, the amount of displacement between the centers 26*a* and 15*a* is 2.12 mm, the amount of displacement between the centers 15*a* and 27*a* is 2.68 mm, and the amount of displacement between the centers 27*a* and 14*a* is 3.24 mm. With such a configuration, the distance between the center 20*a* of the ink supply unit 20 and the center 14*a* of the supporting substrate can be 9.11 mm.

With such the configuration, in the fourth exemplary embodiment, an amount of displacement between the centers 20*a* and 14*a* can be enlarged more than the first to third exemplary embodiments. The aspect ratio of the ink supply unit 20 in the fourth exemplary embodiment is about 2.2 in which the configuration similar to the first exemplary embodiment is used. The aspect ratio of the contact pad group is about 3.2 in which the configuration similar to the second exemplary embodiment is used.

In the fourth exemplary embodiment, configurations similar to any one of the first to third exemplary embodiments show effects similar to any one of the first to third exemplary embodiments.

According to these exemplary embodiments, since the aspect ratio of the ink supply unit 20 is 2 or more, the recording head having a large amount of displacement between the center 20*a* of the ink supply unit 20 and the center 14*a* of the supporting substrate can be obtained while suppressing the influence on the load balance in the X direction when the recording head is mounted on the carriage.

Since the aspect ratio of the contact pad 26 group is 3 or more, the recording having a stable load balance in the Z direction can be obtained when the recording head is mounted on the carriage.

The recording apparatus on which the liquid discharge head according to the exemplary embodiment of the present invention can be mounted will be described with reference to FIG. 8.

Figure 8:
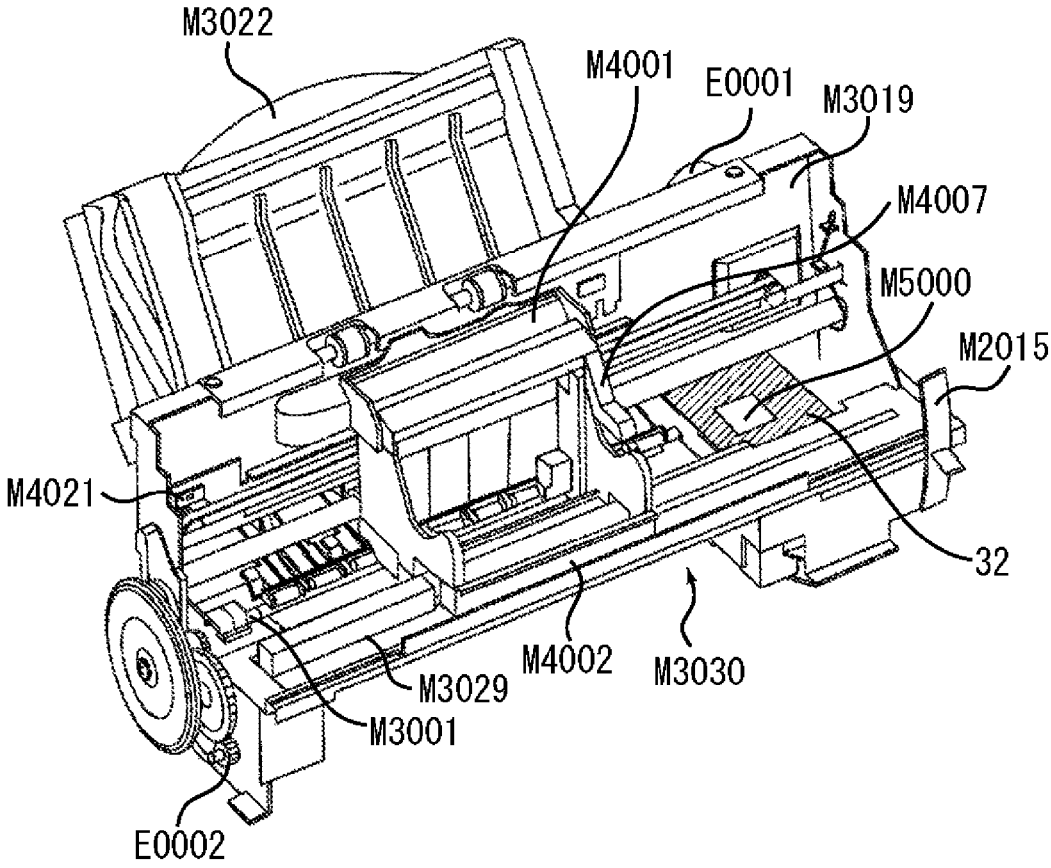
FIG. 8 is a view illustrating a recording apparatus capable of mounting an inkjet recording head of the present invention.

FIG. 8 illustrates a schematic configuration of a recording apparatus using an inkjet recording system and a recording mechanism of the recording apparatus is described.

An ink jet recording apparatus (IJRA), includes an automatic feeding unit M3022 for automatically feeding a recording medium (not illustrated) into an apparatus body and a conveyance unit M3029 for conveying the recording medium from a recording position to a discharge unit M3030.

The recording apparatus IJRA includes a standby area where the liquid discharge head is on stand-by at one end in a reciprocally moving direction of the carriage, i.e., in the main scanning direction, when recording is not performed, and a standby area 32 which is a home position. In the standby area 32, a cap member M5000 is provided which seals a discharge port to prevent ink from drying in the discharge port of the recording head when recording is not performed. The standby area has a width conforming to the width of the recording head 1. The cap member M5000 is provided at a position displaced from the center of the standby area 32 toward the center of the recording apparatus IJRA in the main scanning direction. Since the recording apparatus IJRA has other mechanisms, for example, a recovery mechanism for maintaining reliability of ink discharge, an area for installing these mechanisms is secured in the recording apparatus IJRA.

The recording unit includes a carriage M4001 movably supported by a carriage axis M4021, and a recording head detachably attached to the carriage M4001.

The cap member M5000 is provided in the standby area such that the center of the supporting substrate is in a position corresponding to the center of the cap member M5000 when the recording head is mounted on the carriage and on stand-by in the home position (the standby area 32). By arranging the cap member M5000 in such position, the cap member M5000 can contact the recording element unit 41 to seal the discharge port.

Figures 9A, 9B, 9C:
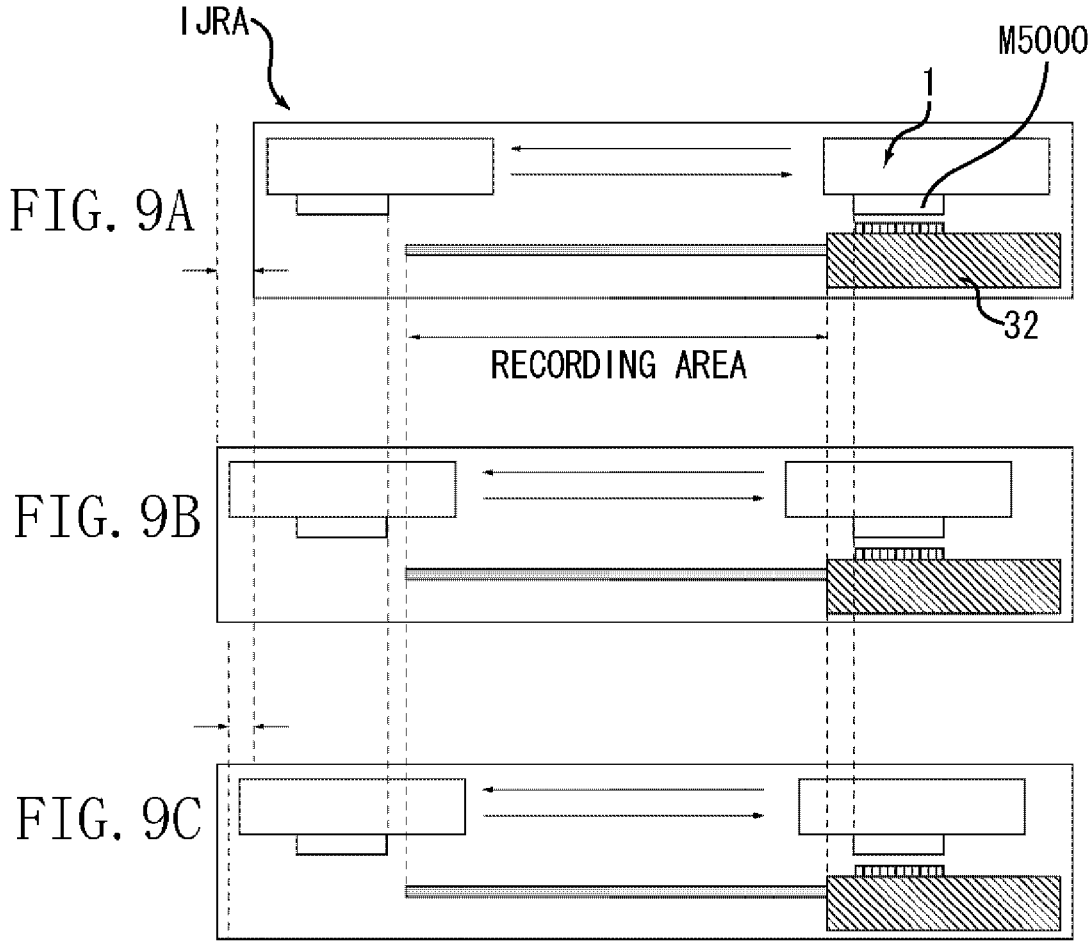
FIGS. 9A, 9B and 9C are schematic views when inkjet recording heads of the present invention and comparative examples are mounted to a recording apparatus.
Figures 12A, 12B, 12C:
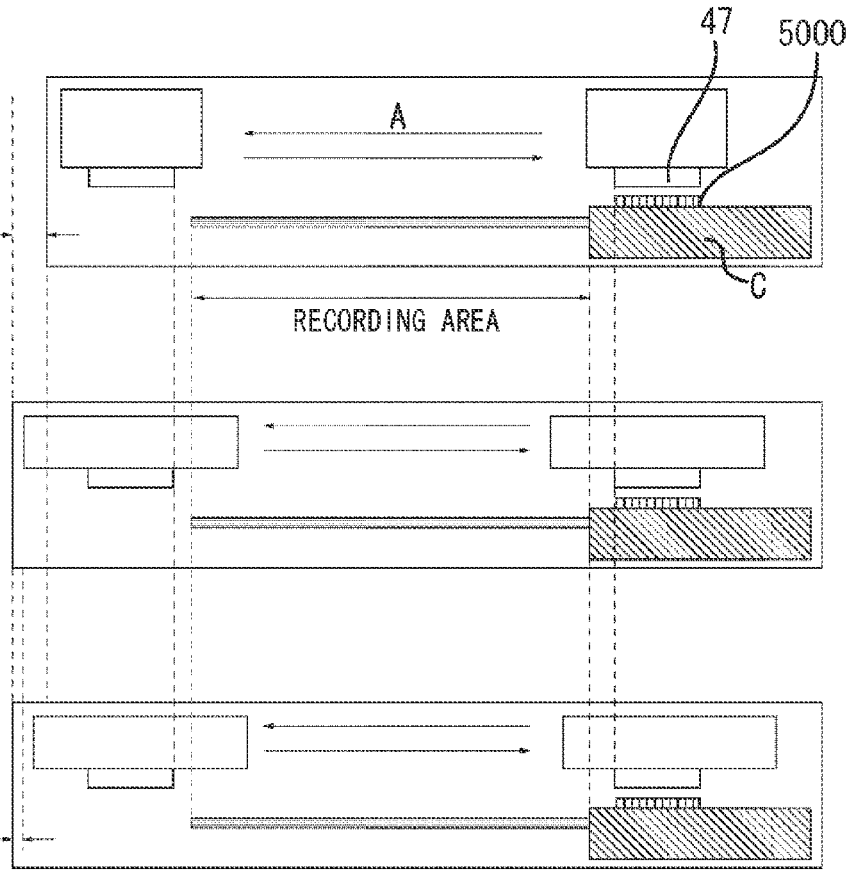
FIGS. 12A, 12B and 12C are views for describing problems of the present invention.

FIG. 9A illustrates the recording head according to the exemplary embodiment of the present invention, which is mounted on the recording apparatus IJRA. FIG. 9B illustrates a configuration similar to the configuration of FIG. 12B and FIG. 9C illustrates a configuration similar to the configuration of FIG. 12C. FIGS. 9B and 9C show comparative examples to the present invention.

As illustrated in FIGS. 9A to 9C, when the recording head according to the exemplary embodiment of the present invention is mounted on the recording apparatus, enlargement of the recording apparatus in the A direction can be reduced even when the recording head is enlarged in the A direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-215697 filed Aug. 25, 2008, which is hereby incorporated by reference herein in its entirety.

What is claimed is:

1. A recording apparatus for performing recording by reciprocally moving a liquid discharge head, the recording apparatus comprising:

the liquid discharge head comprising:

a case;

a connection terminal group including a plurality of connection terminals configured to electrically connect to the recording apparatus, which is provided on one face of the case;

a liquid discharge substrate for discharging a liquid from a discharge port according to a signal transmitted from the recording apparatus via the connection terminals; and a supporting substrate for supporting the liquid discharge substrate, which is provided on another one face of the case, the recording apparatus further comprising:

a standby area provided on one end of the recording apparatus where the liquid discharge head is on stand-by when recording is not performed;

a carriage including a connection terminal which can electrically connect to the liquid discharge head, is mounted with the liquid discharge head, and reciprocally moves between the standby area and another end of the recording apparatus, wherein, in a moving direction of the liquid discharge head from the standby area to the another end of the recording apparatus, a center of the connection terminal group is located at a position displaced from a center of the case, a center of the supporting substrate is located at a position further displaced;

a wiring substrate provided with the connection terminals; and a wiring tape for electrically connecting the liquid discharge substrate and the wiring substrate, wherein a center of an electric connection portion between the wiring substrate and the wiring tape is located between a center of the connection terminal group and a center of the supporting substrate in the moving direction.

2. The recording apparatus according to claim 1, wherein the one face of the case provided with the connection terminal group has a rectangular shape in which a long side is shaped along the moving direction of the liquid discharge head, and wherein an aspect ratio of the one face of the case is 2 or more.

3. The recording apparatus according to claim 1, the liquid discharge head further comprising:

a wiring substrate provided with the connection terminals; and a wiring tape for electrically connecting the liquid discharge substrate and the wiring substrate, wherein a center of the wiring substrate is located between a center of the connection terminal group and a center of the supporting substrate in the moving direction.

4. The recording apparatus according to claim 1, wherein the center of the electric connection portion is located between the center of the wiring substrate and the center of the supporting substrate in the moving direction.

5. The recording apparatus according to claim 1, wherein, in a direction vertical to the moving direction and parallel with the one face of the case provided with the connection terminals group, a distance between the center of the electric connection portion and the center of the supporting substrate is greater than a distance between the center of the case and the center of the connection terminal group.

6. The recording apparatus according to claim 2, wherein the connection terminal group is arranged to have a rectangular shape in which a long side is shaped along the moving direction of the liquid discharge head, and wherein an aspect ratio of the connection terminal group is 3 or more.

7. The recording apparatus according to claim 3, wherein the wiring tape is arranged on a face provided with the connection terminal group and a face provided with the supporting substrate, and wherein the center of the supporting substrate is located at an approximately same position as the center of a portion of the wiring tape arranged on the face provided with the supporting substrate, in the moving direction.

8. The recording apparatus according to claim 3, wherein, in the direction vertical to the moving direction and parallel with the one face of the case provided with the connection terminal group, the center of the wiring substrate is displaced to a side provided with the liquid discharge substrate from the center of the case.

9. The recording apparatus according to claim 6, wherein the aspect ratio of the connection terminal group is greater than the aspect ratio of the one face of the case.

10. The recording apparatus according to claim 8, wherein, in the direction vertical to the moving direction and parallel with the one face of the case provided with the connection terminal group, the center of the connection terminal group is displaced from the center of the wiring substrate to a side opposite to the side provided with the liquid discharge substrate.

* * * * *